US011133618B2

(12) United States Patent
Hsu

(10) Patent No.: US 11,133,618 B2
(45) Date of Patent: Sep. 28, 2021

(54) ELECTRICAL CONNECTOR WITH HYBRID CONTACT SET

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventor: Shuo-Hsiu Hsu, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 55 days.

(21) Appl. No.: 16/741,640

(22) Filed: Jan. 13, 2020

(65) Prior Publication Data

US 2020/0235514 A1 Jul. 23, 2020

(30) Foreign Application Priority Data

Jan. 21, 2019 (CN) ..... 201910055329.0

(51) Int. Cl.

| | |
|---|---|
| ***H01R 13/24*** | (2006.01) |
| ***H01R 13/502*** | (2006.01) |
| ***H01R 4/58*** | (2006.01) |
| *H01R 12/57* | (2011.01) |

(52) U.S. Cl.

CPC ..... *H01R 13/245* (2013.01); *H01R 4/58* (2013.01); *H01R 13/502* (2013.01); *H01R 12/57* (2013.01)

(58) Field of Classification Search

CPC ..... H01R 13/245; H01R 4/58; H01R 13/502; H01R 12/57; H01R 12/52; H01R 13/2435; H01R 13/2442; H01R 13/2485; H01R 12/714; H01R 13/2414; H01R 13/6474; H01R 31/06

USPC ..... 439/626, 65, 66, 68, 70, 71

See application file for complete search history.

(56) References Cited

U.S. PATENT DOCUMENTS

| | | | | |
|---|---|---|---|---|
| 6,155,845 | A * | 12/2000 | Lin | H05K 7/1061 439/83 |
| 6,955,545 | B1 * | 10/2005 | Morana | H01R 13/112 439/83 |
| 7,001,190 | B2 * | 2/2006 | Morana | H05K 3/3426 439/81 |
| 7,445,461 | B1 * | 11/2008 | Polnyi | H01R 13/2407 439/66 |
| 7,553,202 | B2 * | 6/2009 | Ma | H01R 12/57 439/839 |
| 7,819,671 | B2 * | 10/2010 | Liu | H01R 13/2435 439/66 |
| 7,862,343 | B1 * | 1/2011 | Lin | H01R 13/2435 439/66 |

(Continued)

*Primary Examiner* — Travis S Chambers

(74) *Attorney, Agent, or Firm* — Ming Chieh Chang; Wei Te Chung

(57) ABSTRACT

An electrical connector includes a plurality of contact units each having a first part and a second part mechanically and electrically connected to each other wherein the first part provides the spring contacting section for performing the superior mechanical resiliency while the second part provides the mounting section soldered upon the printed circuit board and configured to lower the impedance compared with the first part and provide strong retention thereof.

20 Claims, 13 Drawing Sheets

(56) References Cited

U.S. PATENT DOCUMENTS

| | | | | |
|---|---|---|---|---|
| 8,608,516 | B2 * | 12/2013 | Huang | H01R 13/432 439/751 |
| 8,888,502 | B2 * | 11/2014 | Terhune, IV | H01R 12/7076 439/66 |
| 9,130,322 | B2 * | 9/2015 | Hsu | H01R 12/7082 |
| 10,707,606 | B2 * | 7/2020 | Ho | H01R 12/712 |
| 2011/0009007 | A1 * | 1/2011 | Gattuso | H05K 7/1061 439/660 |
| 2016/0043488 | A1 * | 2/2016 | Heppner | G01R 1/0466 361/783 |
| 2019/0199029 | A1 * | 6/2019 | Ju | H01R 13/2442 |

* cited by examiner

ELECTRICAL CONNECTOR WITH HYBRID CONTACT SET

BACKGROUND OF THE DISCLOSURE

1. Field of the Disclosure

The present disclosure relates to an electrical connector, and particularly to the electrical connector with the corresponding contacts of which each is composed of two parts having different electrical characteristics.

2. Description of Related Arts

The fine pitch arrangement of the contacts in an electrical connector requires to meet both the mechanical and electrical performance wherein the mechanical characteristics refer to the mating normal force, and the electrical characteristics refer to the lower impedance. For the traditional one piece contact, it is relatively hard to get a better balance between the preferred mechanical characteristic and the electrical characteristic both.

An improved connector assembly is desired to provide an electrical connector with the corresponding contacts having both the preferred mechanical characteristic and electrical characteristic.

SUMMARY OF THE DISCLOSURE

An object of the invention is to provide an electrical connector with a plurality of contact units each including a first part and a second part mechanically and electrically connected to each other wherein the first part provides the spring contacting section for performing the superior mechanical resiliency while the second part provides the mounting section soldered upon the printed circuit board and configured to lower the impedance compared with the first part and provide strong retention thereof.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
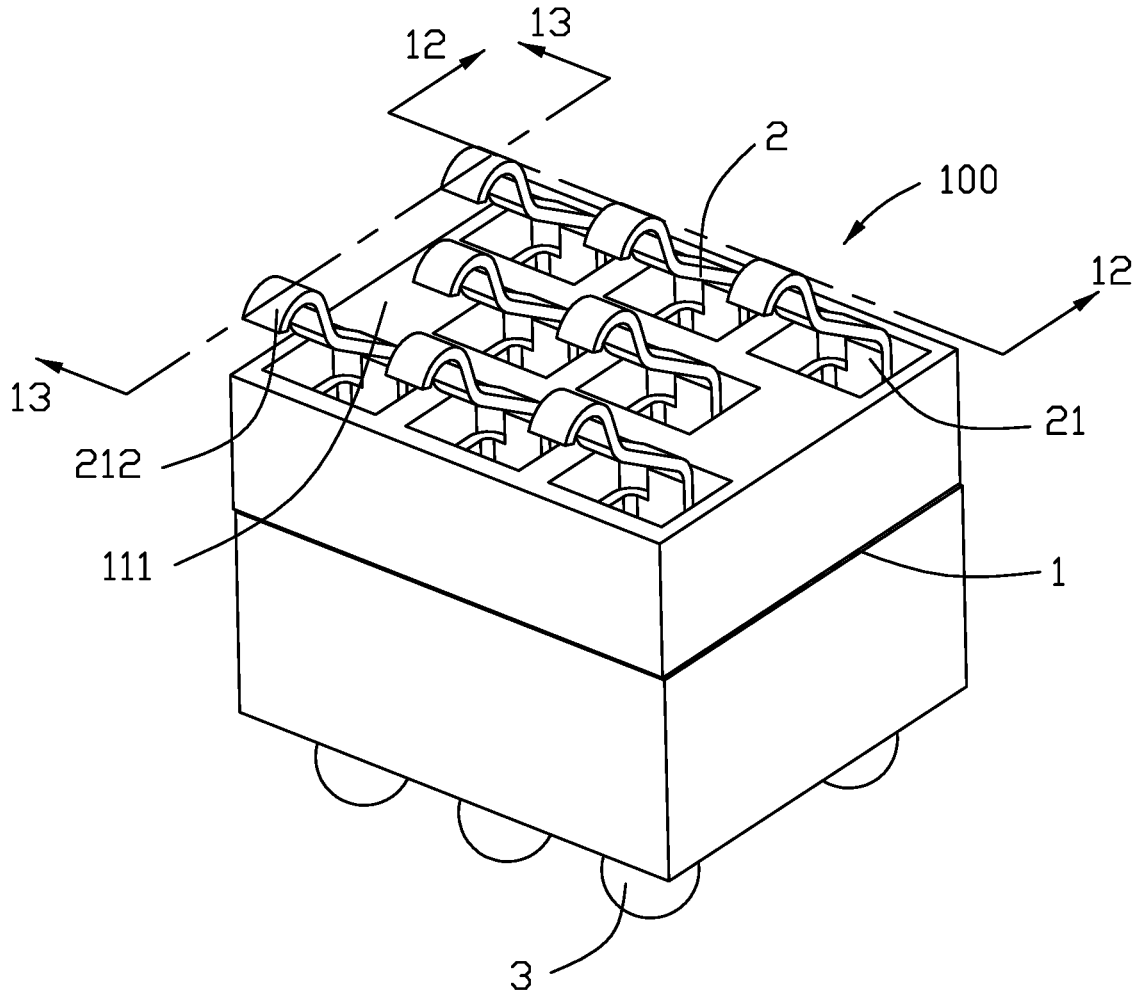
FIG. 1 is a perspective view of an electrical connector of the invention.
Figure 2:
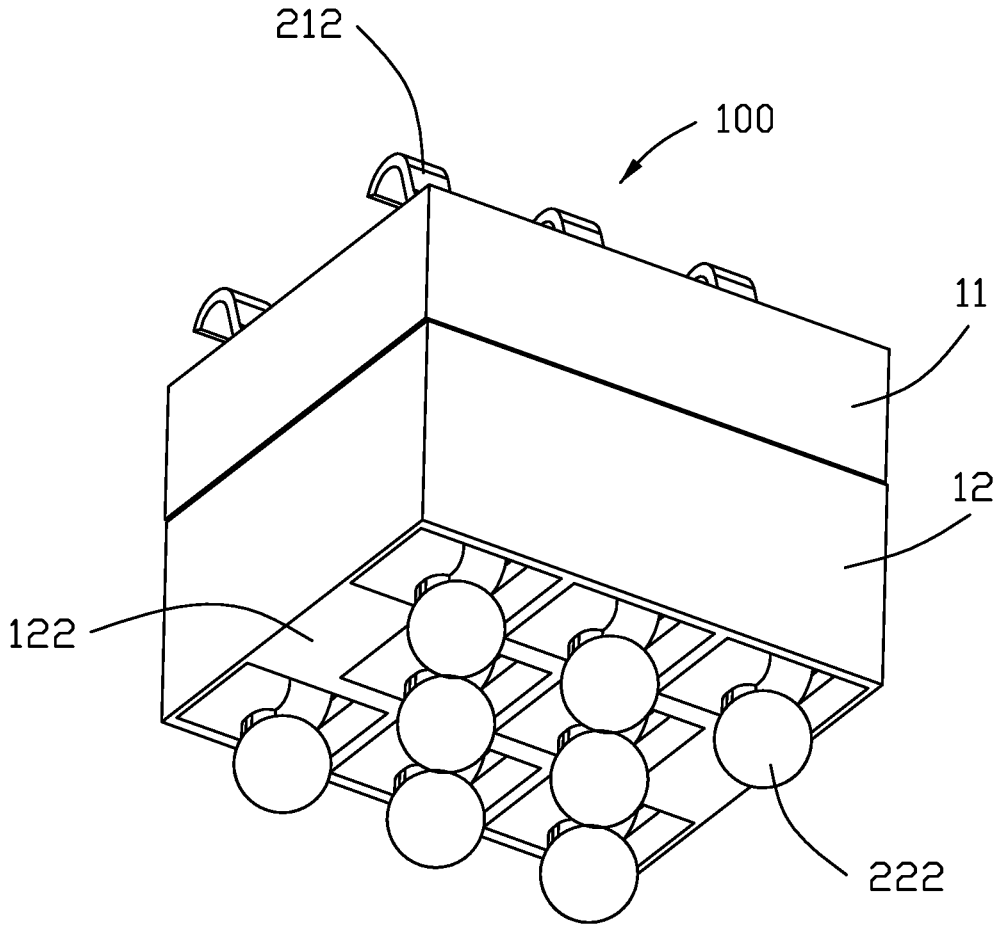
FIG. 2 is another perspective view of the electrical connector of FIG. 1.
Figure 3:
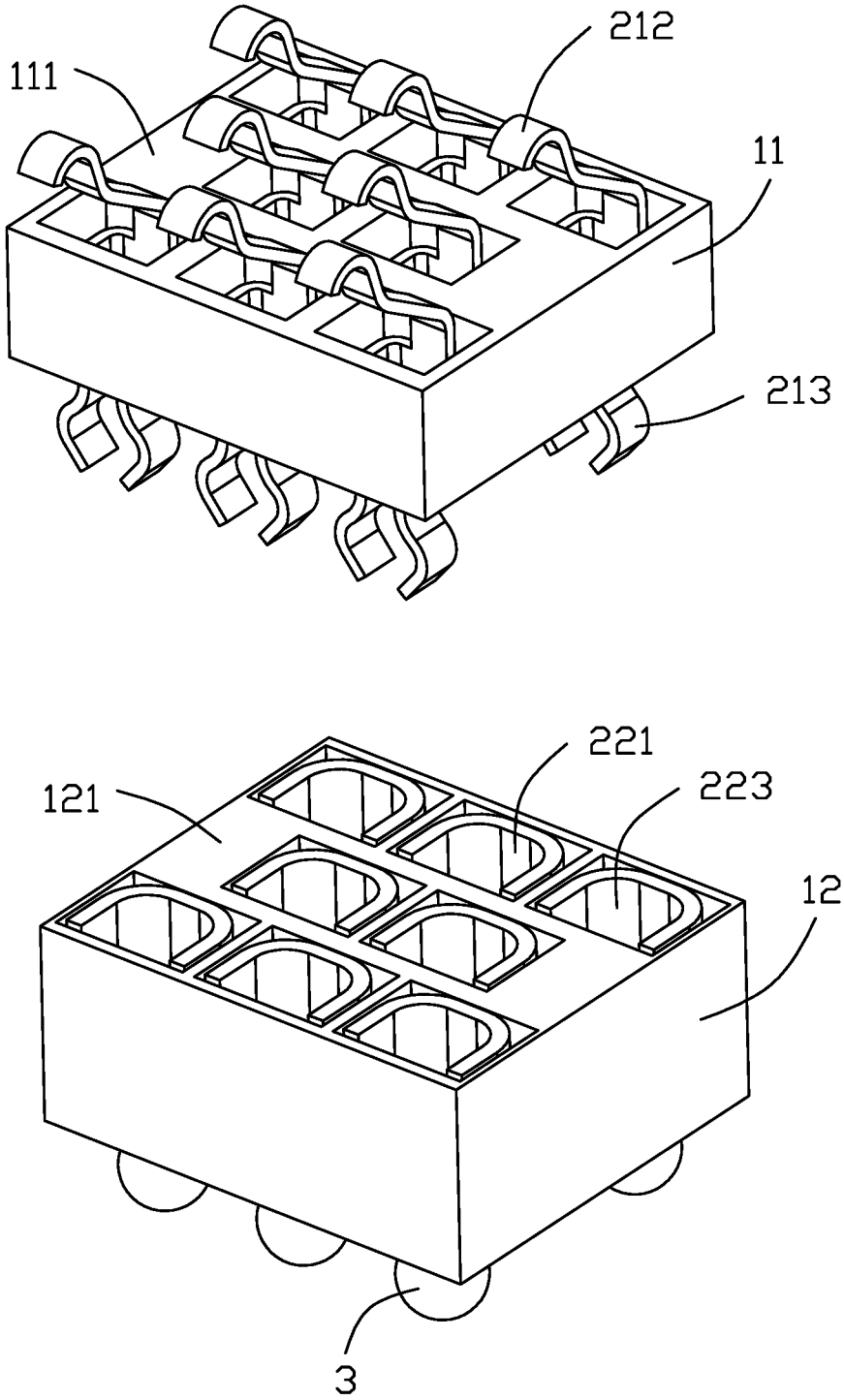
FIG. 3 is an exploded perspective view of the electrical connector of FIG. 1.
Figure 4:
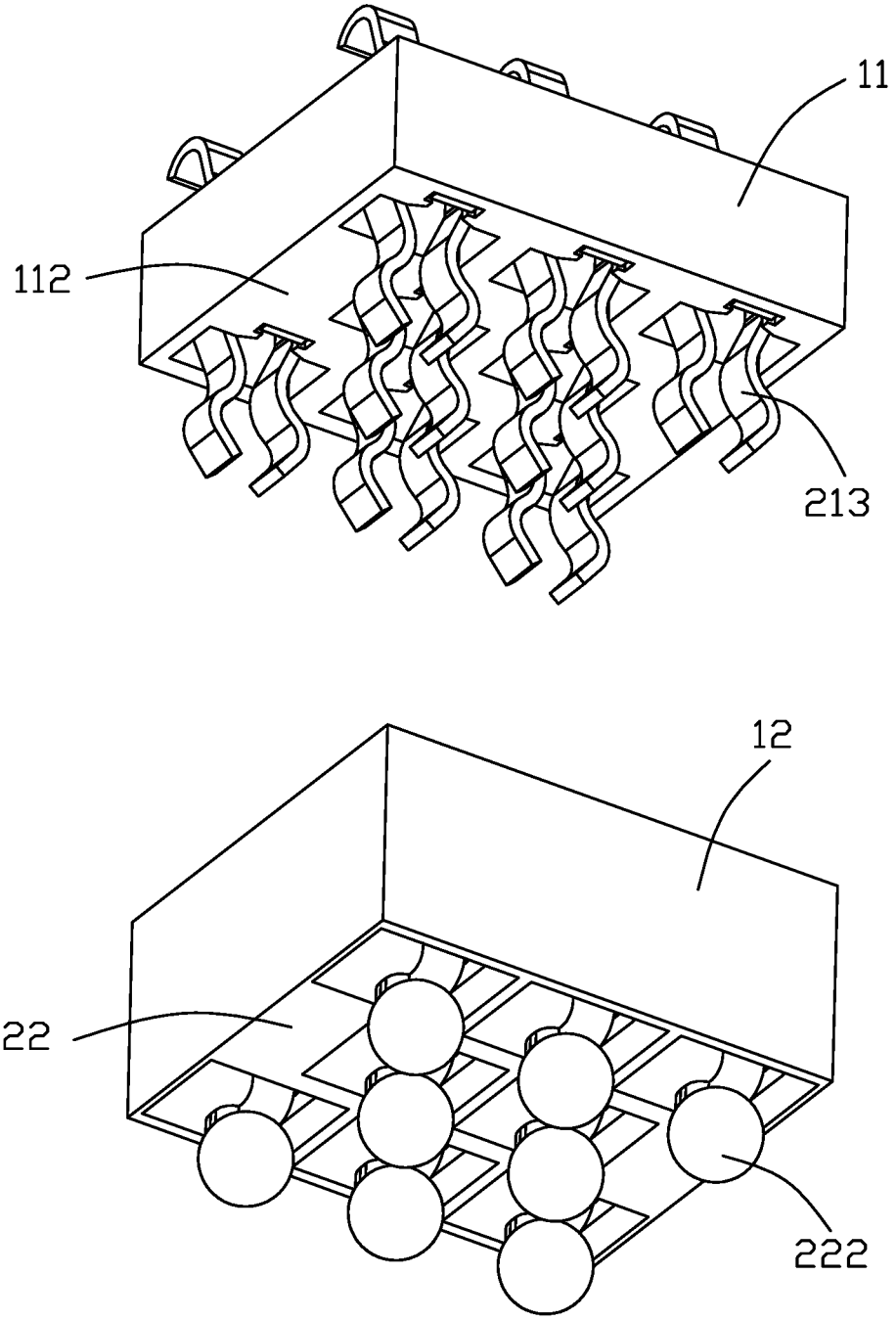
FIG. 4 is another exploded perspective view of the electrical connector of FIG. 3.
Figure 5:
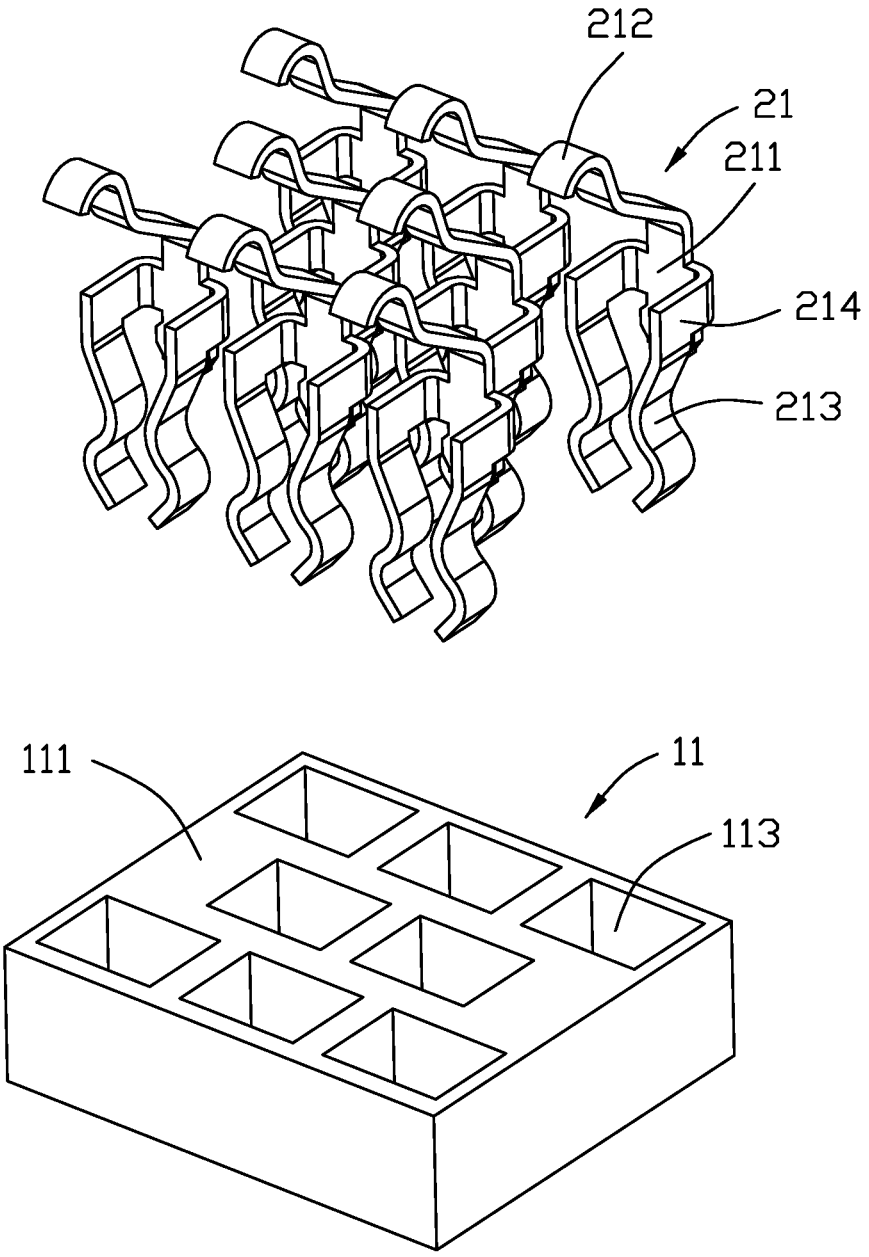
FIG. 5 is an exploded perspective view of the first/upper portion of the electrical connector of FIG. 3.
Figure 6:
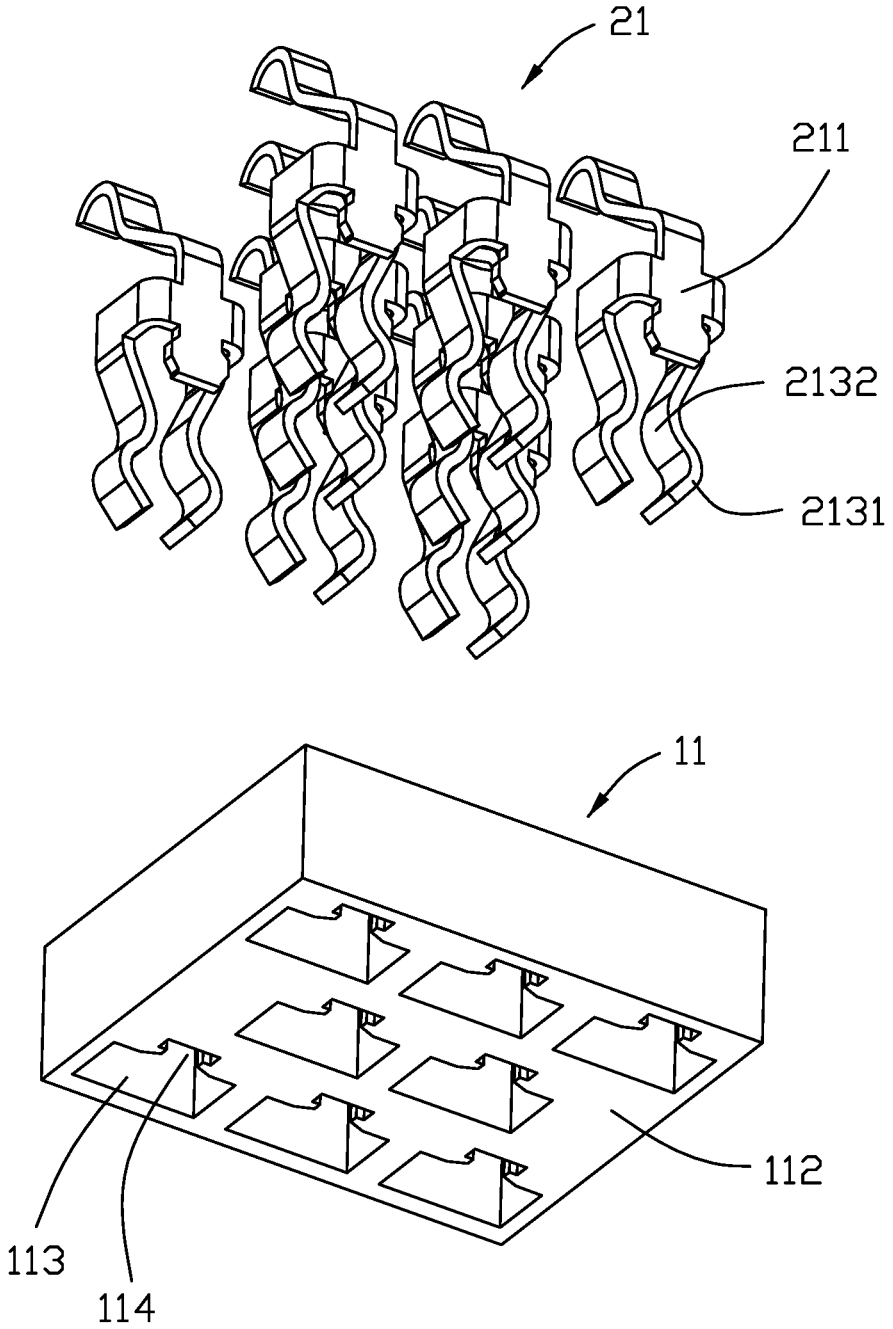
FIG. 6 is another exploded perspective view of the first/upper portion of the electrical connector of FIG. 5.
Figure 7:
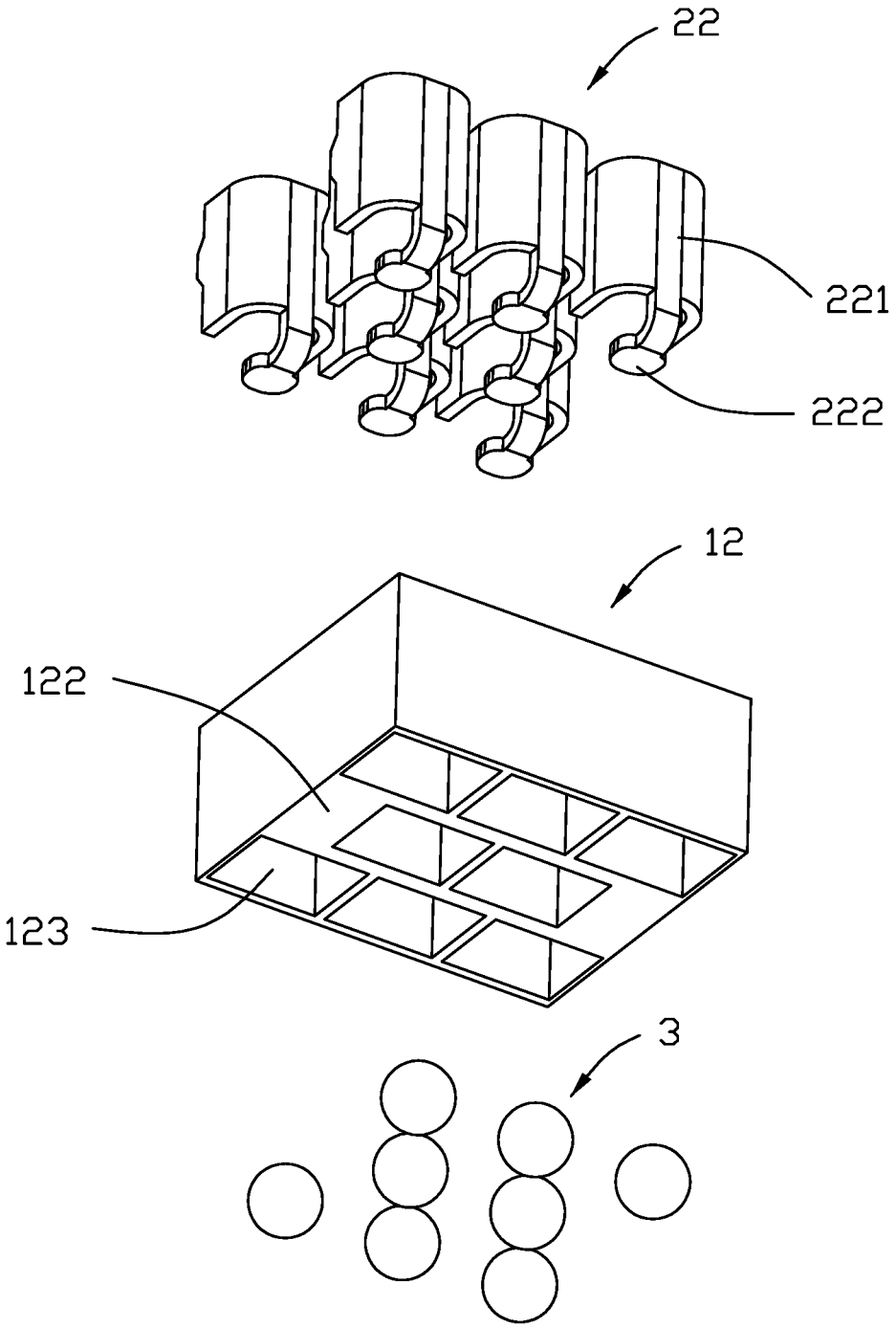
FIG. 7 is an exploded perspective view of the second/lower portion of the electrical connector of FIG. 3.
Figure 8:
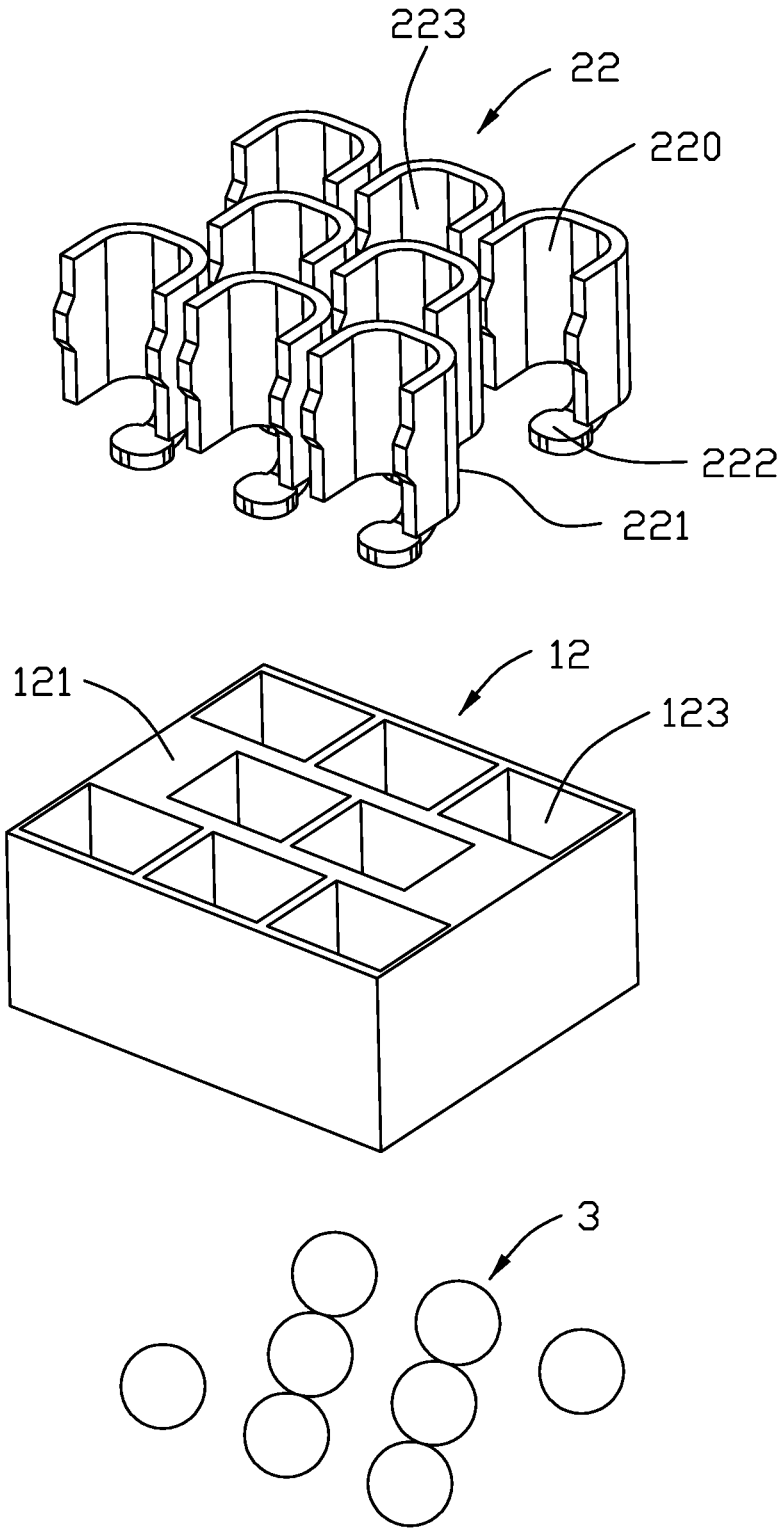
FIG. 8 is another exploded perspective view of the second/lower portion of the electrical connector of FIG. 7
Figure 9:
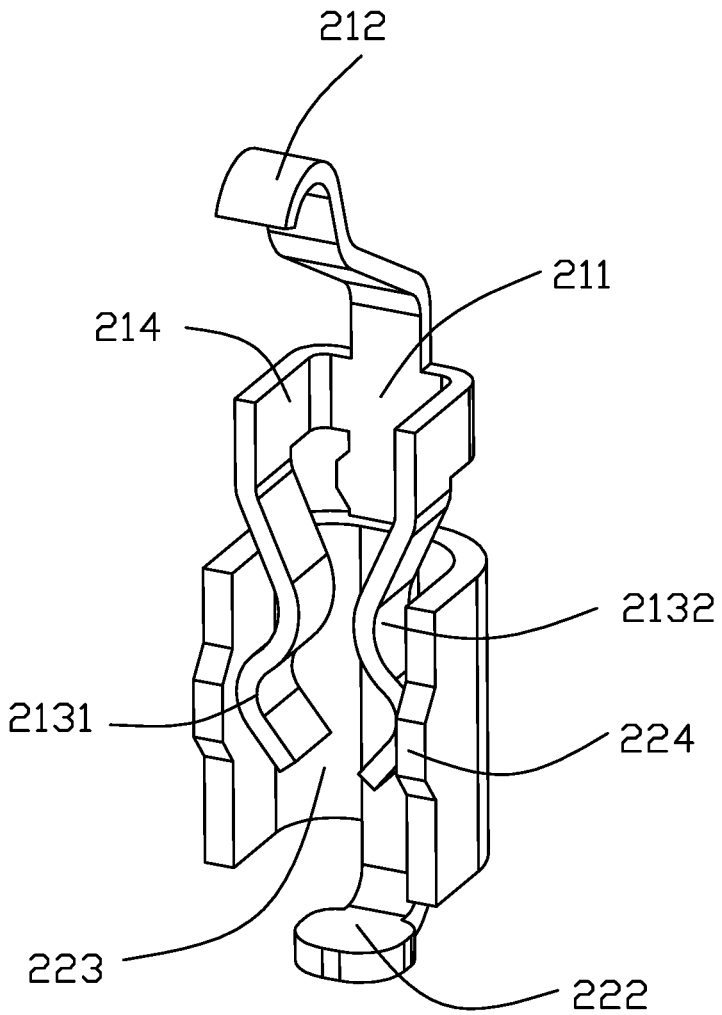
FIG. 9 is a perspective view of the contact of the electrical connector of FIG. 3.
Figure 10:
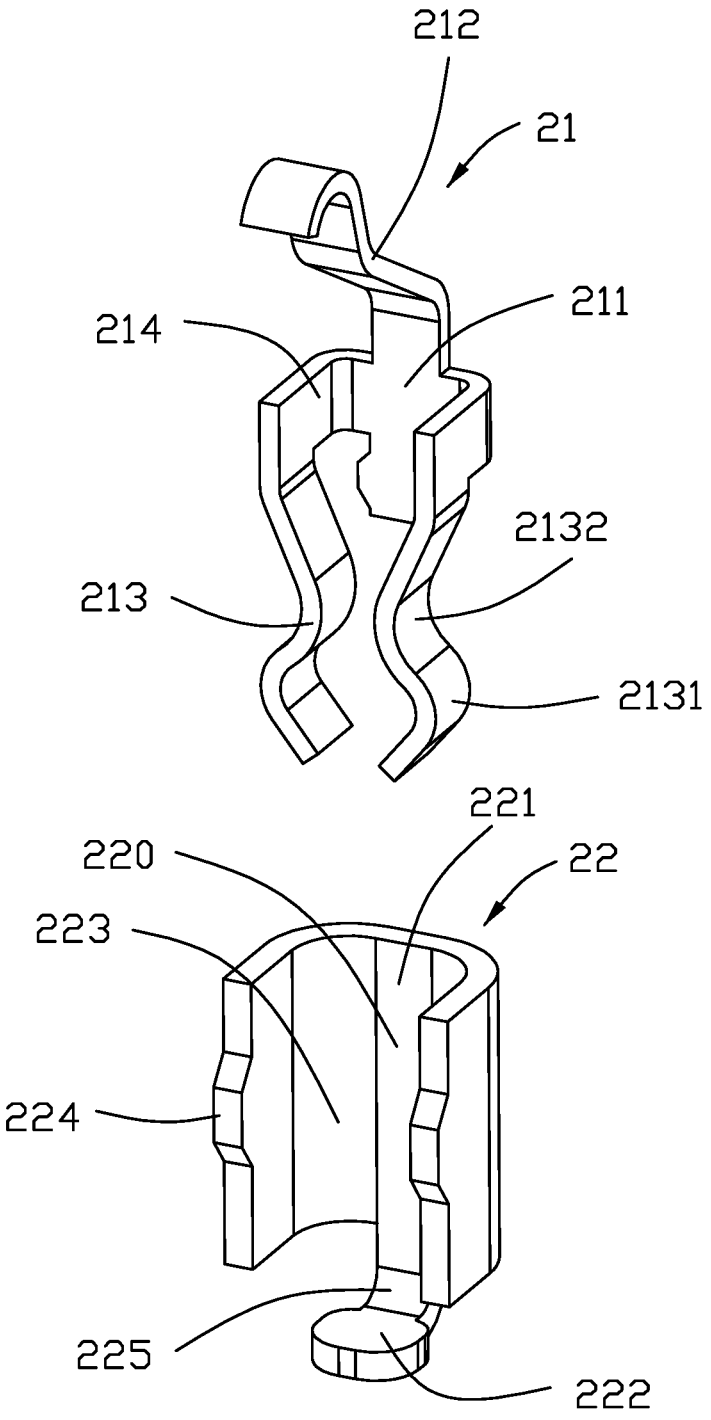
FIG. 10 is an exploded perspective view of the contact of the electrical connector of FIG. 9
Figure 11:
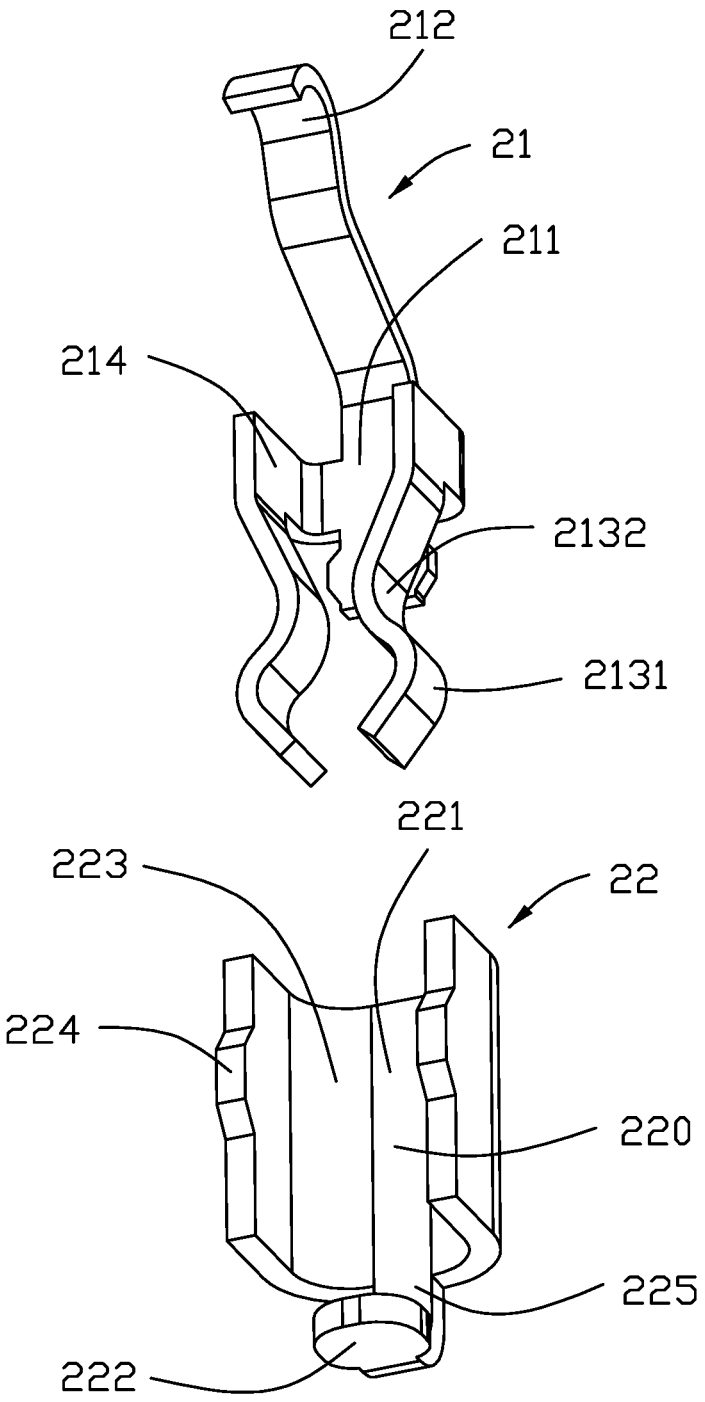
FIG. 11 is another exploded perspective view of the contact of the electrical connector of FIG. 10.
Figure 12:
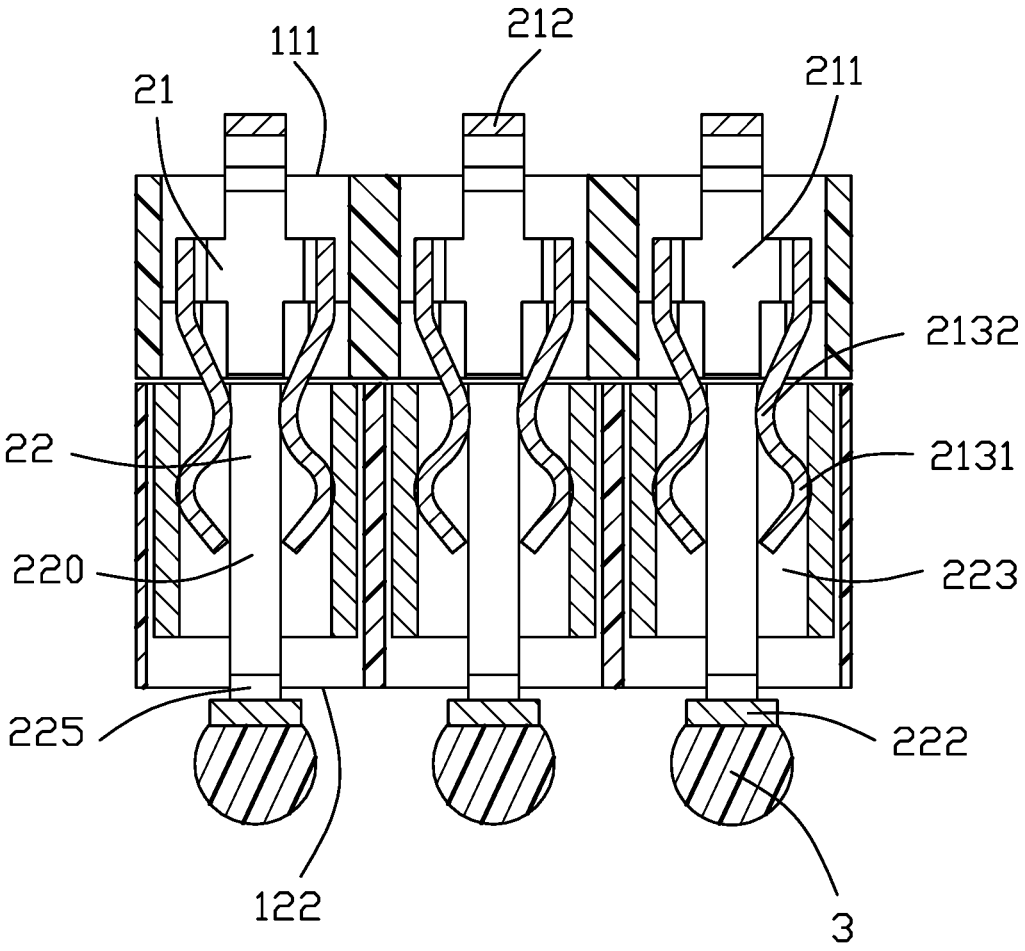
FIG. 12 is a cross-sectional view of the electrical connector of FIG. 1 taken along line 12-12.
Figure 13:
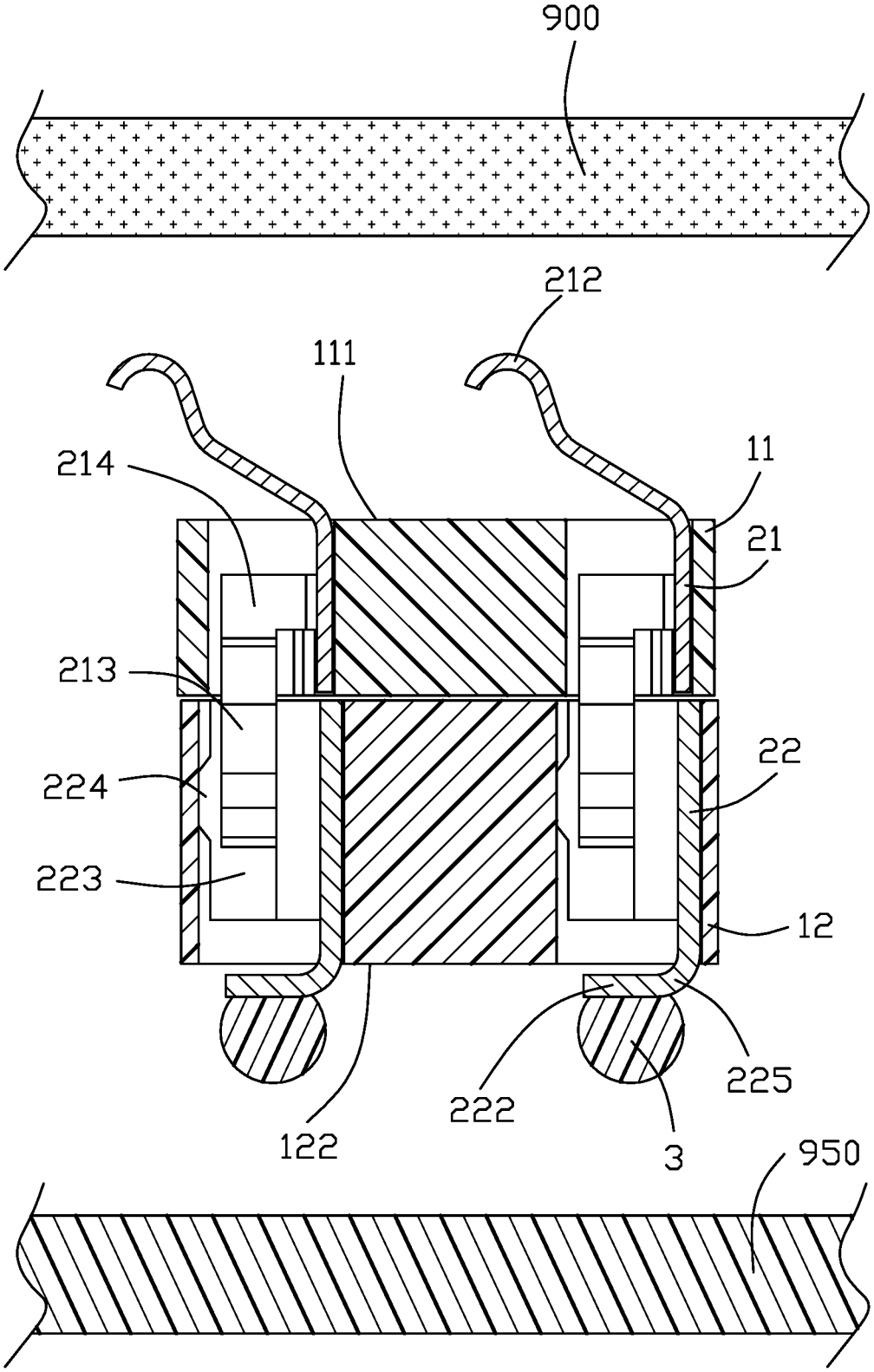
FIG. 13 is a cross-sectional view of the electrical connector of the of FIG. 1 taken along line 13-13.

Referring to FIGS. 1-13, an electrical connector.100 for connecting an electronic package or a CPU (Central Processing Unit) 900 to a printed circuit board 950, includes an insulative housing 1 and a plurality of contacts 2 therein.

The housing 1 includes a first/upper insulator 11 having opposite upper surface 111 and lower surface 112, and a second/lower insulator 12 secured upon an upper surface 111 of the first insulator 11 and having opposite upper surface 121 and the lower surface 122. The first insulator 11 includes a plurality of first/upper passageways each having a first receiving slot 113 and a securing slot 114 adjacent thereto. The second insulator 12 includes a plurality of second/lower passage or receiving slots 23 in alignment with the corresponding first receiving slots 113, respectively, in the vertical direction.

The contact includes a first/upper part 21 and a second/lower part 22. The first part 21 is retained to the first insulator 11 while the second part 22 is retained to the second insulator 12 and constantly mechanically and electrically connected to the first part 21. Preferably, the first part 21 and the second part 22 are soldered with each other. The first part 21 includes a first body 211 secured to the first insulator 11, and a contacting section 212 extending upwardly from the first body 211 and above the upper surface 111 of the first insulator 11. The second part 22 includes a second body 221 and a soldering leg 222 extending downwardly from the second body 221 and beyond/below the lower surface 122 of the second insulator 12. The first part 21 further includes a first/upper linking section 213 and the second part 22 further includes a second/lower linking section 223 mechanically and electrically connected to the first linking section 213. Preferably, the first linking section 213 is soldered to the second linking section 223.

The first body 211 forms a U-shaped structure, and the first linking section 213 includes a pair of spring tangs linked to the first body 211 via the first connecting sections 214 of the first body 211 and configured with convex sections 2131 and the concave sections 2132 wherein the first linking section 213 is linked to the second linking section 223 via the convex sections 2131. The second linking section 223 forms a U-shaped structure, and the pair of spring tangs of the first linking section 213 is inserted within and contact the second linking section 223. The first linking section 213 is partially located in the first receiving slot 113 and partially extends below the lower surface 112 of the first insulator 11, while the first body 211 is retained in the securing slot 114. The second body 221 of the second part 22 is received within the second receiving slot 123. The second part 22 further includes a connecting section 225 linked between the second body 221 and the leg 222.

The second linking section 223 forms a barbed structure 224 to retain the second part 22 in the corresponding second receiving slot 123 in the second insulator 12. The first linking section 213 extends into the second receiving slot 123 to contact the second linking section 223. Optimally, solder attachment may be applied to an interface between the first linking section 213 and the second linking section 223.

In this embodiment, both first part 21 and the second part 22 are derived from sheet metal via stamping and forming wherein a thickness of the first part 21 is smaller than that of the second part 22. For example, the first part 21 may adopt a thickness of 0.05 mm~0.08 mm while the second part 22 may adopt a thickness of 0.2 mm~0.4 mm with the superior conductivity thereof. Understandably, the relative thicker second part 22 not only reliably retains the contact 2 with regarding to the insulative housing 1 but also provides a preferred impedance thereof, and the relatively thin first part 21 may provide the desired resiliency for lowering the improper normal force between the CPU 900 and the contact 2.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector for connection between an electronic package and a printed circuit board, comprising:

a plurality of contacts disposed in an insulative housing, each contact including an upper part and a lower part discrete from each other, the insulative housing including an upper insulator and a lower insulator discrete from each other;

said upper insulator forming a plurality of upper passageways extending therethrough in a vertical direction to receive the corresponding upper parts of the contacts;

said lower insulator forming a plurality of lower passageways extending therethrough in the vertical direction to receive the corresponding lower parts of the contacts; wherein the upper part is mechanically and electrically connected to the corresponding lower part in a one-to-one relation, the upper part includes a spring arm for connecting the electronic package and the lower part includes a solder leg for mounting to the printed circuit board, and the upper part is different from the lower part materially; wherein a thickness of the upper part is smaller than that of the lower part.

2. The electrical connector as claimed in claim 1, wherein conductivity of material of the lower part is larger than that of the upper part.

3. The electrical connector as claimed in claim 1, wherein the upper part includes an upper linking section, the lower part includes a lower linking section mechanically and electrically connected to the upper linking section.

4. The electrical connector as claimed in claim 3, wherein the upper linking section is soldered to the lower linking section.

5. The electrical connector as claimed in claim 3, wherein the resilient one of the upper linking section and the lower linking section includes a pair of spring tangs respectively abutting against two opposite portion of a U-shaped structure of the other.

6. The electrical connector as claimed in claim 3, wherein one of the upper linking section and the lower linking section is resilient.

7. The electrical connector as claimed in claim 6, wherein the upper linking section is resilient and downwardly extends into the corresponding lower passageway.

8. The electrical connector as claimed in claim 3, wherein one of the upper linking section and the lower linking section extends from one of the upper passageway and the lower passageway where said one of the upper linking section and the lower linking section is located, and into the other of the upper passageway and the lower passageway where the other of the upper linking section and the lower linking section is located.

9. The electrical connector as claimed in claim 8, wherein said one of the upper linking section and the lower linking section is the upper linking section.

10. An electrical connector for connection between an electronic package and a printed circuit board, comprising:

an insulative housing retaining a plurality of contacts therein, each of said contacts including an upper part and a lower part discrete from each other;

the housing defining in a vertical direction an upper portion and a lower portion to receive the upper parts and the lower parts of the contacts, respectively; wherein the upper part is mechanically and electrically connected to the corresponding lower part in a one-to-one relation, the upper part includes a spring arm for connecting the electronic package and the lower part includes a solder leg for mounting to the printed circuit board, and the upper part is different from the lower part materially; wherein a thickness of the upper part is smaller than that of the lower part.

11. The electrical connector as claimed in claim 10, wherein conductivity of material of the lower part is larger than that of the upper part.

12. The electrical connector as claimed in claim 10, wherein the upper portion and the lower portion are discrete from each other in the vertical direction.

13. The electrical connector as claimed in claim 10, wherein the upper part includes an upper linking section, the lower part includes a lower linking section mechanically and electrically connected to the upper linking sections.

14. The electrical connector as claimed in claim 13, wherein one of the upper linking section and the lower linking section is resilient.

15. The electrical connector as claimed in claim 14, wherein the upper linking section is resilient.

16. The electrical connector as claimed in claim 13, wherein one of the upper linking section and the lower linking section extends from one of the upper passageway and the lower passageway where said one of the upper linking section and the lower linking section is located, and into the other of the upper passageway and the lower passageway where the other of the upper linking section and the lower linking section is located.

17. The electrical connector as claimed in claim 16, wherein said one of the upper linking section and the lower linking section is the upper linking section.

18. An electrical connector for connection between an electronic package and a printed circuit board, comprising:

an insulative housing retaining a plurality of contacts therein, each of said contacts including an upper part and a lower part;

the housing defining in a vertical direction an upper portion and a lower portion to receive the upper parts and the lower parts of the contacts, respectively; wherein the upper part is mechanically and electrically connected to the corresponding lower part in a one-to-one relation, the upper part includes a spring arm for connecting the electronic package and the lower part includes a solder leg for mounting to the printed circuit board, and the upper part is different from the lower part materially; wherein conductivity of material of the lower part is larger than that of the upper part.

19. The electrical connector as claimed in claim 18, wherein the upper part includes a resilient linking section extending downwardly into the lower portion of the housing to mechanically and electrically connect the corresponding lower part.

20. The electrical connector as claimed in claim 19, wherein the linking section is soldered with the lower part.

* * * * *